US010508572B2

(12) United States Patent
Mainiero

(10) Patent No.: US 10,508,572 B2
(45) **Date of Patent: *Dec. 17, 2019**

(54) OIL AND AIR SEPARATOR SYSTEM ADAPTER AND METHOD

(71) Applicant: Joe Mainiero, Lake Worth, FL (US)

(72) Inventor: Joe Mainiero, Lake Worth, FL (US)

( * ) Notice: Subject to any disclaimer, the term of this patent is extended or adjusted under 35 U.S.C. 154(b) by 134 days.

This patent is subject to a terminal disclaimer.

(21) Appl. No.: 15/421,489

(22) Filed: Feb. 1, 2017

(65) Prior Publication Data

US 2018/0216507 A1 Aug. 2, 2018

(51) Int. Cl.

| | |
|---|---|
| ***B01D 49/00*** | (2006.01) |
| ***B01D 35/16*** | (2006.01) |
| ***F01M 11/04*** | (2006.01) |
| ***F01M 13/04*** | (2006.01) |
| ***F16N 31/00*** | (2006.01) |
| ***F16L 37/088*** | (2006.01) |
| ***F16L 37/092*** | (2006.01) |

(52) U.S. Cl.

CPC ..... *F01M 13/04* (2013.01); *F01M 11/04* (2013.01)

(58) Field of Classification Search

CPC ..... B01D 49/00; B01D 35/16; B01D 36/006; F01M 11/0458; F01M 11/0408; F01M 11/04; F01M 13/04; F16N 31/00; Y10T 137/86332; F16L 19/0653; F16L 19/0231; F16L 37/088; F16L 37/092

USPC ..... 55/315, 318, 320, 321, 325, 385.1, 428, 55/495, 467, 470–473, 344; 15/327; 96/134, 136, 139, 152, 11; 210/295; 285/81

See application file for complete search history.

(56) References Cited

U.S. PATENT DOCUMENTS

| | | | | | |
|---|---|---|---|---|---|
| 3,676,986 | A * | 7/1972 | Reiling | A47L 5/38 | 15/314 |
| 3,773,360 | A * | 11/1973 | Timbers | F16L 37/088 | 285/307 |
| 4,133,564 | A * | 1/1979 | Sarson | F16L 37/088 | 285/321 |
| 4,702,754 | A * | 10/1987 | Blocker | B01D 46/0012 | 137/223 |
| 5,022,687 | A * | 6/1991 | Ariga | F16L 37/092 | 285/321 |
| 5,284,586 | A * | 2/1994 | DeSalvo | B01D 29/012 | 210/448 |
| 5,522,910 | A * | 6/1996 | Fogal, Sr. | B01D 46/0012 | 137/223 |
| 5,676,719 | A * | 10/1997 | Stavropoulos | B01D 35/02 | 137/549 |
| 6,110,259 | A * | 8/2000 | Schultz | A61B 18/00 | 55/385.1 |
| 7,014,215 | B2 * | 3/2006 | Cooper | F16L 19/0231 | 285/247 |
| 7,614,390 | B2 * | 11/2009 | Holzmann | B01D 45/04 | 123/572 |

(Continued)

*Primary Examiner* — Minh Chau T Pham

(74) *Attorney, Agent, or Firm* — Uradnik Law Firm PC

(57) ABSTRACT

An adapter for the intake side of an oil and air separation system, including a first end portion capable of replacing an engine oil fill cap, the first end portion connected to an intermediate portion that removably engages with a second end portion including a hose coupling that allows the adapter to be connected to the intake side of an oil and air separation system via a hose.

16 Claims, 5 Drawing Sheets

(56) References Cited

U.S. PATENT DOCUMENTS

| | | | | |
|---|---|---|---|---|
| 7,841,629 | B2 * | 11/2010 | Hoffmann | F16L 37/088 285/276 |
| 8,753,436 | B1 * | 6/2014 | Curtsinger | B01D 46/001 55/318 |
| 8,974,569 | B2 * | 3/2015 | Matula | A61M 13/003 210/295 |
| 2009/0101562 | A1 * | 4/2009 | Newton | A61M 3/02 210/232 |
| 2009/0107090 | A1 * | 4/2009 | Keel | B01D 46/0012 55/385.4 |
| 2010/0170208 | A1 * | 7/2010 | Matula | A61M 13/003 55/344 |
| 2010/0171302 | A1 * | 7/2010 | Yoder | F16L 37/0925 285/81 |
| 2011/0239599 | A1 * | 10/2011 | Woo | B24B 55/10 55/368 |
| 2013/0298509 | A1 * | 11/2013 | Magno, Jr. | B01D 49/00 55/428 |
| 2014/0069521 | A1 * | 3/2014 | Sakai | F17C 13/002 137/315.01 |
| 2015/0061283 | A1 * | 3/2015 | Peirce | F16L 19/0653 285/291.1 |
| 2015/0174514 | A1 * | 6/2015 | Lin | B01D 35/30 96/11 |
| 2015/0251120 | A1 * | 9/2015 | Jakop | B01D 46/0005 55/496 |
| 2018/0306077 | A1 * | 10/2018 | Mainiero | F01M 13/0405 |

* cited by examiner

OIL AND AIR SEPARATOR SYSTEM ADAPTER AND METHOD

FIELD OF THE DISCLOSURE

The invention relates generally to engine positive crankcase ventilation (PCV) systems and methods for recycling blow-by gases through a PCV valve into the engine's intake manifold, and more particularly in one exemplary embodiment, to systems and methods including an adapter to replace an oil fill cap and to provide a pathway for blow-by gases to travel from the crankcase to the intake side of an oil and air separator system for removal of crankcase oil from such blow-by gases.

BACKGROUND

In a combustion engine, blow-by gases typically include unburned gasoline. That is, an amount of air and unburned gasoline from the engine cylinder is pulled past the piston rings and into the crankcase. Instead of exhausting such blow-by gases to the atmosphere, a positive crankcase ventilation (PCV) system recycles the blow-by gases through a PCV valve into the engine's intake manifold. Such recycling occurs when the engine is operating at relatively slow speeds (e.g. idling), i.e., when the air pressure in the crankcase is higher than the air pressure in the intake manifold.

One problem associated with PCV systems and their use involves oil vapors. An engine's crankcase is used to store oil. A pan located below the crankshaft holds oil, and generally oil vapors from the oil in the pan may find their way into the blow-by gases.

It is undesirable for oil to be recycled with blow-by gases into an engine's intake manifold. Such oil may degrade engine performance by lowering the overall octane of the combustion mixture in a cylinder. Such oil also may coat the air intake and prevent airflow.

To combat the presence of oil in blow-by gases, oil and air separators were developed to remove the oil from the blow-by gases before recirculation into the intake manifold. There are various different models or types of oil and air separators available. With all such systems, the intake side of the oil and air separator is connected to a vent or evacuation tube for the crankcase.

This approach to oil and air separation is not without its drawbacks, however. It would prove advantageous to eliminate the need for a separate vent or evacuation tube by using the engine oil fill port to exhaust blow-by gases from the crankcase.

SUMMARY

The present disclosure provides an adapter for the intake side of an oil and air separation system. In one exemplary embodiment, the adapter includes a first end portion capable of replacing an engine oil fill cap. The first end portion is connected to an intermediate portion that removably engages with a second end portion including a hose coupling that allows the adapter to be connected to the intake side of an oil and air separation system via a hose.

Other benefits and advantages of the present disclosure will be appreciated from the following detailed description.

DETAILED DESCRIPTION

Figure 1:
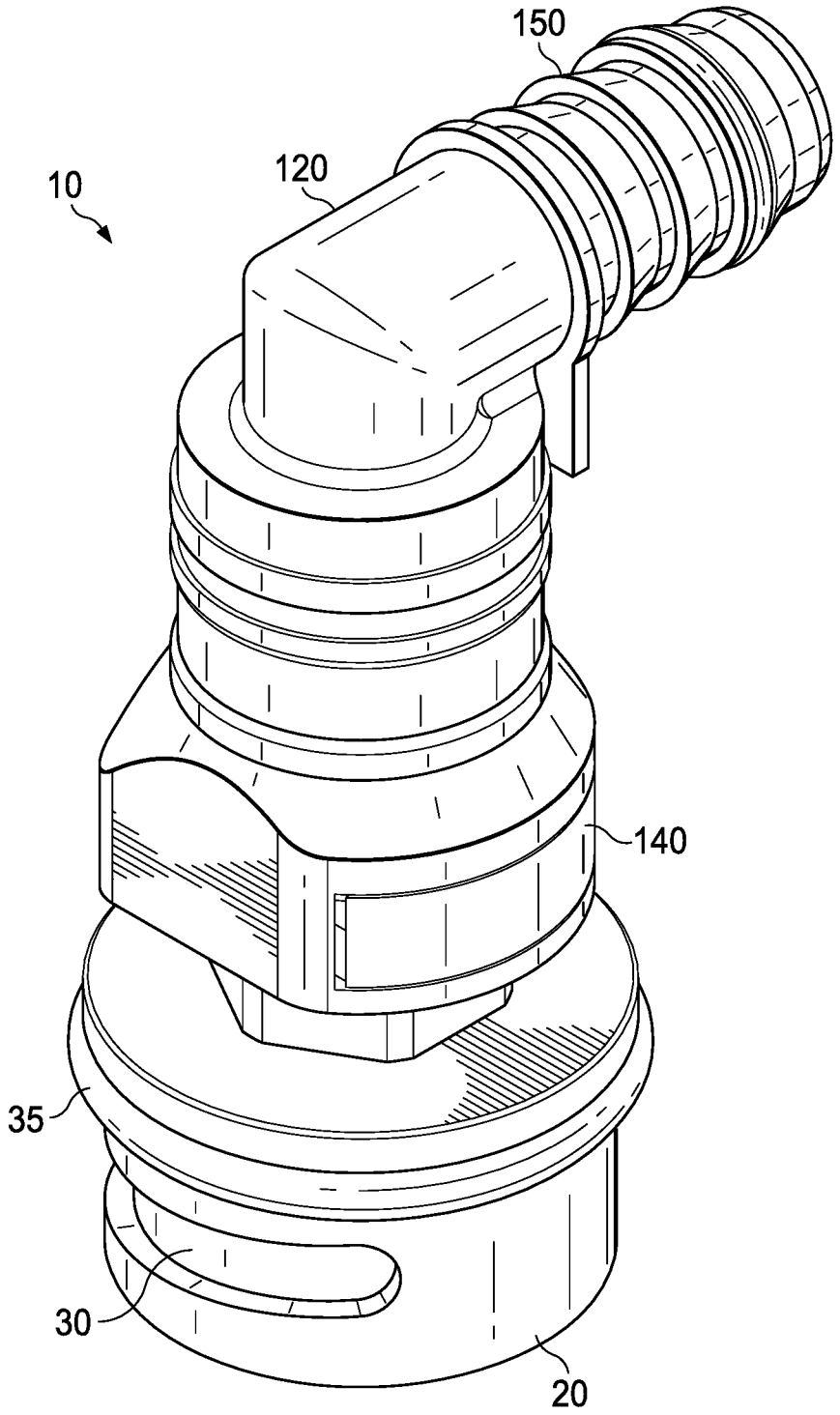
FIG. 1 is a perspective view of an exemplary embodiment of an adapter for use between an engine oil fill port and an oil and air separation can.
Figure 2:
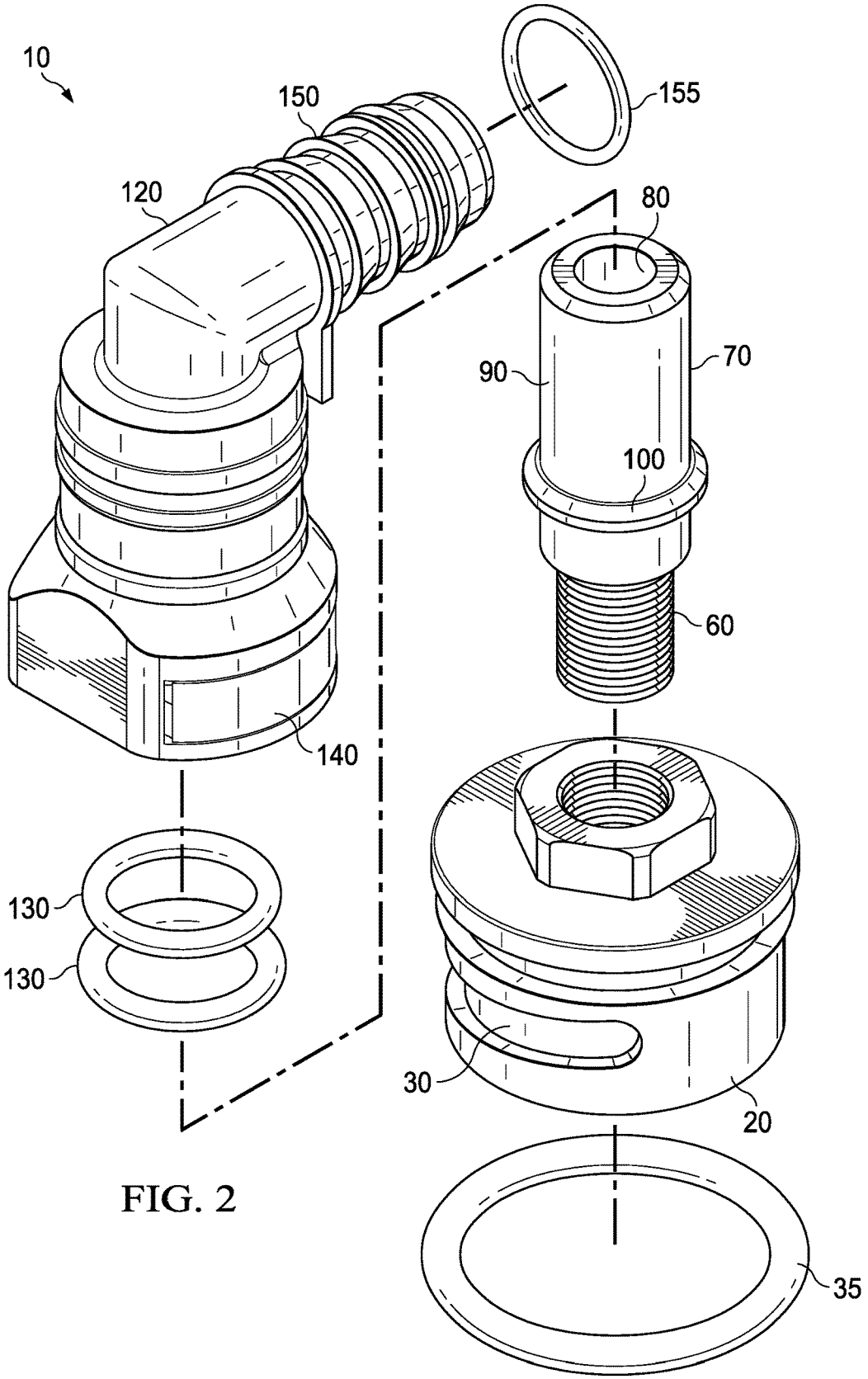
FIG. 2 is an exploded-view drawing of the exemplary embodiment of the adapter shown in FIG. 1.
Figure 3:
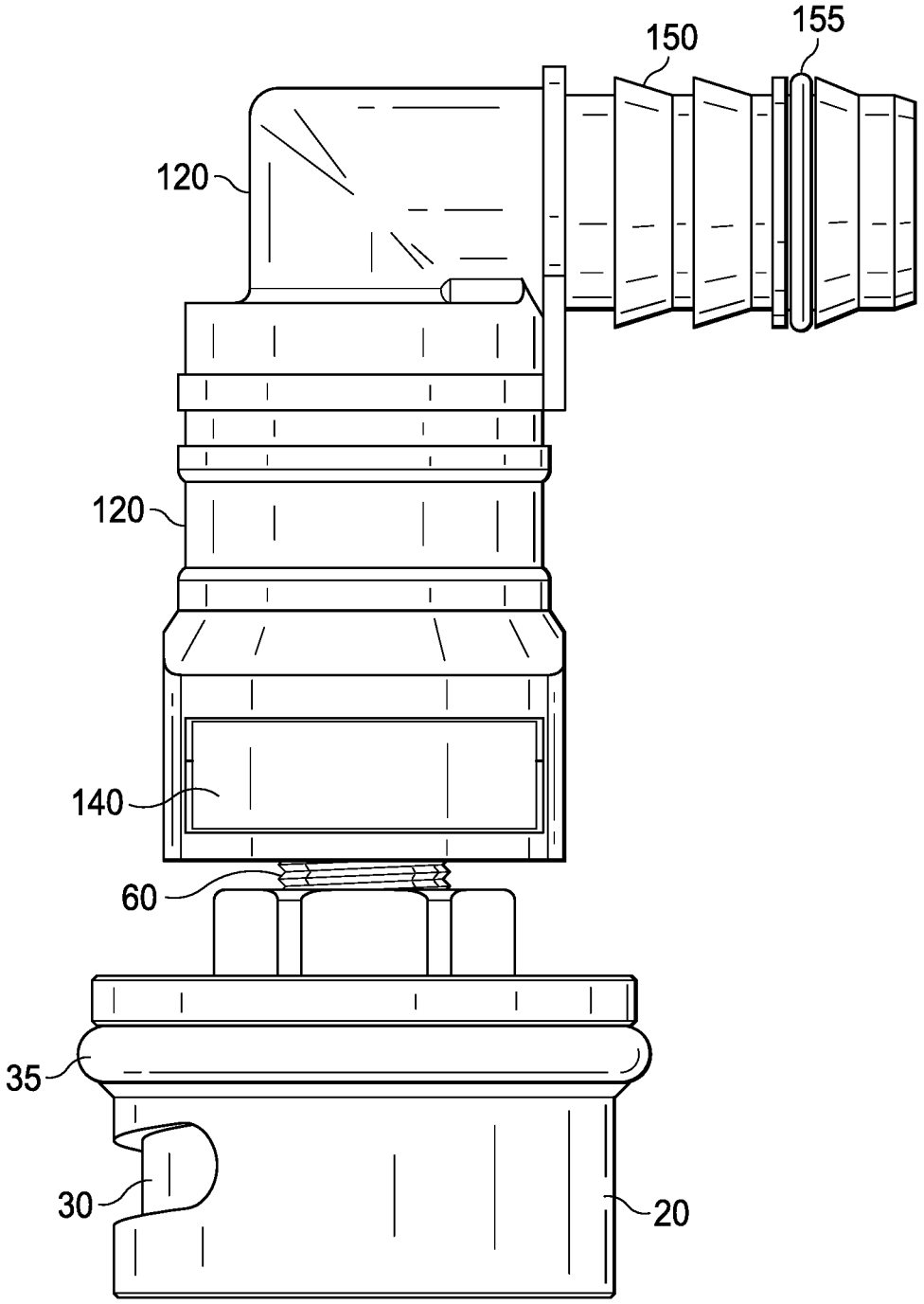
FIG. 3 is a profile-view drawing of the exemplary embodiment of the adapter shown in FIG. 1.
Figure 4:
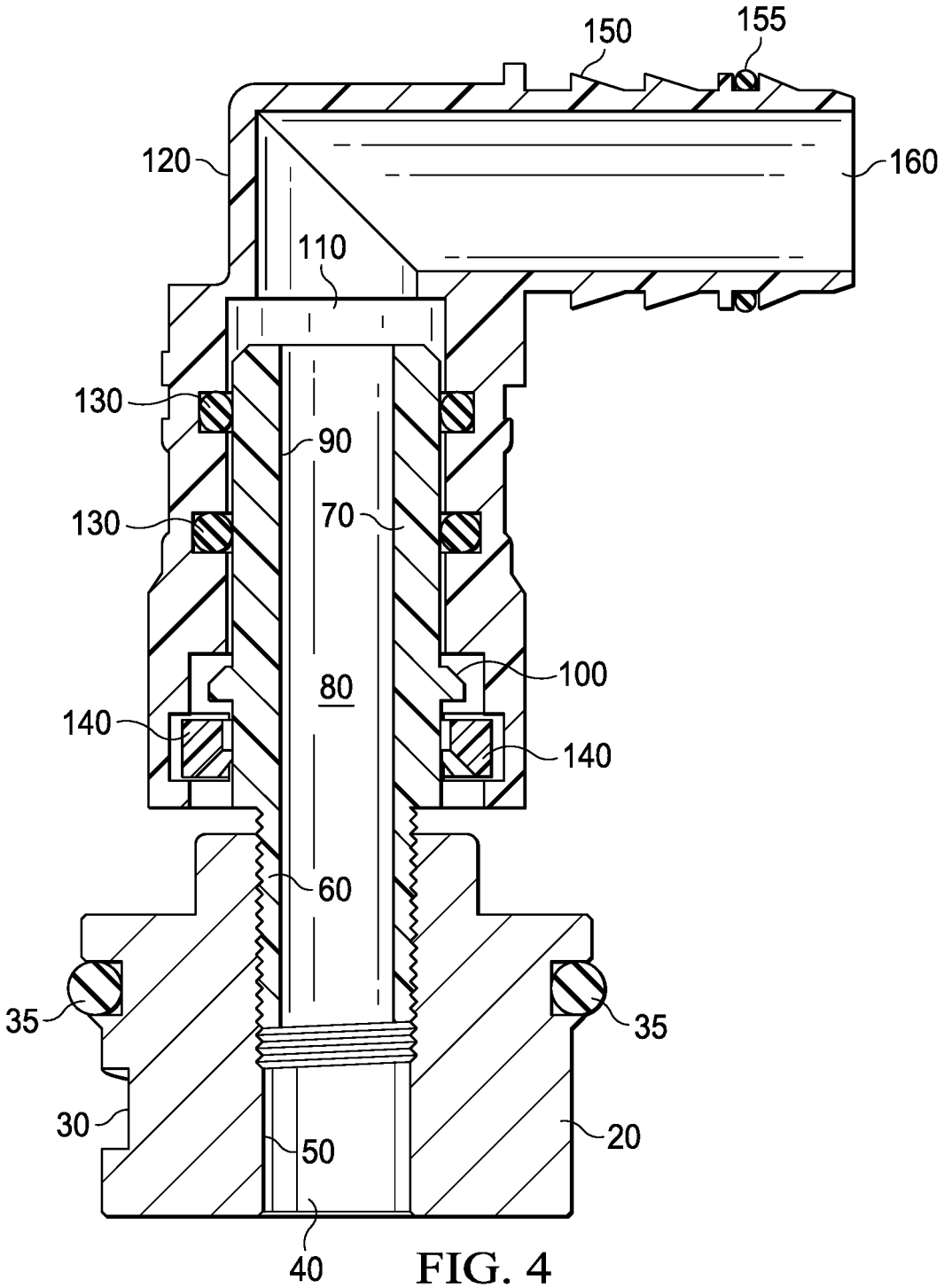
FIG. 4 is cross-sectional view of the exemplary embodiment of the adapter shown in FIG. 1.
Figure 5:
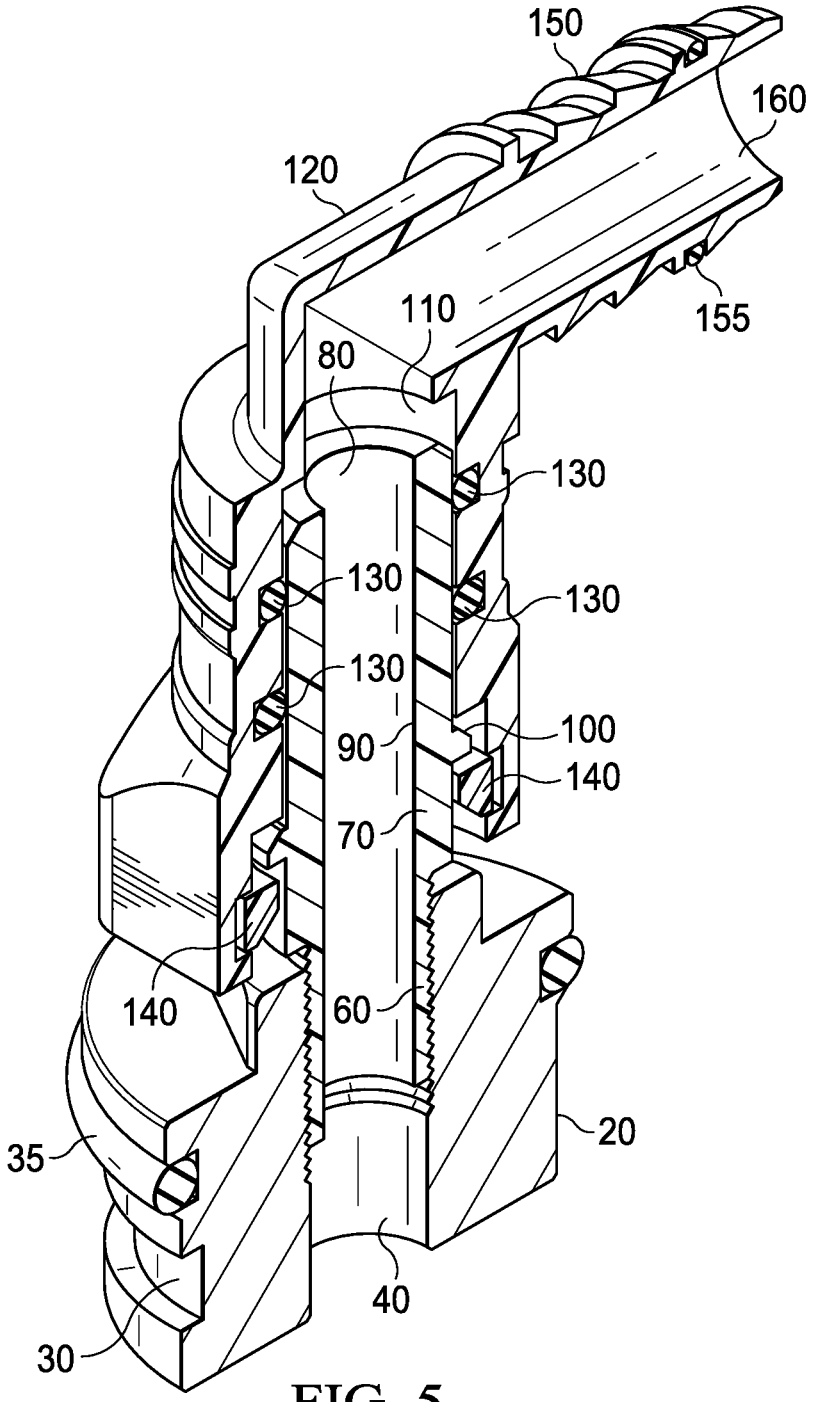
FIG. 5 is a sectional elevation view of the exemplary embodiment of the adapter shown in FIG. 1.

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to oil and air separation and adapter use; etc. Such aspects related to this disclosure do not depart from the invention, and it is therefore intended that the invention not be limited by the certain aspects set forth of the events and circumstances related to this disclosure.

Turning now to the drawings, the figures show an exemplary embodiment of an adapter 10 for use between an engine oil fill port and an oil and air separation can. A first end portion 20 includes a threaded portion 30, so that the first end portion 20 may releasably engage an engine oil fill port in place of an engine oil fill cap. The first end portion 20 may include a generally centrally disposed lumen 40 therethrough. The sidewall 50 of the lumen 40 may be threaded at least in part, so that a male-threaded portion 60 of the intermediate portion 70 of adapter 10 may threadingly releasably engage with the female-threaded portion of the sidewall 50 of lumen 40. An o-ring 35 or gasket may be positioned about first end portion 20 to help seal the engagement of first end portion 20 to the engine oil fill port and help prevent the escape of blow-by gases.

The intermediate portion 70 may be generally cylindrical in shape, and include a generally centrally disposed passageway 80 therethrough. Opposite the male-threaded portion 60 may be a barrel-like portion 90. Disposed between the opposite ends of intermediate portion 70 may be a shoulder 100.

The barrel-like portion 90 and shoulder 100 may be sized for insertion at least in part into a receiving lumen 110 disposed at least in a portion of second end portion 120 of adapter 10. One or more o-rings 130 may be used to help prevent fluid passage between the barrel-like portion 90 and the second end portion 120.

Upon insertion of the barrel-like portion 90 and shoulder 100 into receiving lumen 110, a button 140 may be engaged by the shoulder 100 to releasably hold the barrel-like portion 90 and shoulder 100 in place as inserted into the receiving lumen 110. Depressing and holding the button 140 disengages the button 140 from the shoulder 100 and allows the shoulder 100 and barrel-like portion 90 to be removed from receiving lumen 110. A removable clip also may be used as an alternative to the button 140 to releasably hold the barrel-like portion 90 and shoulder 100 within receiving lumen 110.

At the end of the second end portion 120 of adapter 10 opposite the receiving lumen 110 may be disposed a hose coupling 150. As shown in the drawings, the hose coupling 150 includes a barbed portion that may be inserted into the end of a hose connected to the intake side of an oil and air separation can. Other forms of hose couplings also may be used. An o-ring 155 may be used to help prevent fluid passage between the hose and hose coupling 150. An opening 160 through the hose coupling 150 is in fluid communication with the receiving lumen 110. Thus, upon assembly and installation of the adapter 10, a continuous fluid pathway is formed for blow-by gases between an engine crankcase and an oil and air separation can.

In accordance with the description herein, a robust adapter assembly is provided. The first end portion 20 is adapted to fit an engine oil fill port, which often is a standard size across numerous different models of automobiles. The first end portion 20 may be connected to an intermediate portion 70 and second end portion 120 of a desired size and shape, with a desired-size fluid passageway therethrough and desired size hose coupling 150. Such adaptability is advantageous since fluid passageway and hose coupling sizes often may vary across various automobiles.

In accordance with the description herein, to add oil to an engine with an adapter 10 installed, one need only disconnect the intermediate portion 70 and second end portion 120 (i.e., by depressing the button 140 and pulling the parts apart), and then remove the first end portion 20 in much the same way that an engine oil fill cap is removed. Separating the parts in this way also may prove advantageous when replacing or when emptying an oil and air separator.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

What is claimed is:

1. An adapter for use between an engine oil fill port and an intake side of an oil and air separation can comprising:

a first end portion including means for releasably engaging an engine oil fill port;

a second end portion including a non-threaded lumen disposed therein; and an intermediate portion including a male threaded portion releasably threadingly engaged with the first end portion, and including a barrel-like portion releasably received within the non-threaded lumen;

wherein the first end portion, the second end portion, and the intermediate portion form a continuous fluid passageway therethrough for blow-by gases exiting the engine oil fill port.

2. The adapter of claim 1, wherein the intermediate portion includes a shoulder releasably received within the non-threaded lumen.

3. The adapter of claim 2, wherein a button engages the shoulder to releasably hold the barrel-like portion and the shoulder within the non-threaded lumen.

4. The adapter of claim 3, wherein the second end portion includes a hose coupling.

5. The adapter of claim 3, wherein an o-ring is disposed between the barrel-like portion and a sidewall of the non-threaded lumen.

6. The adapter of claim 4 wherein an o-ring is disposed on the hose coupling.

7. A fluid passageway for blow-by gases exiting an engine crankcase including:

a first lumen formed within a first end portion including a means for releasably engaging an engine oil fill port; and a second lumen in fluid communication with the first lumen, the second lumen formed within an intermediate portion having a first end threadingly releasably coupled to the first end portion.

8. The fluid passageway of claim 7, wherein the intermediate portion includes a non-threaded barrel-like second end portion.

9. The fluid passageway of claim 8, including a non-threaded lumen in fluid communication with the second lumen, the non-threaded lumen formed within a second end portion.

10. The fluid passageway of claim 9, wherein the non-threaded barrel-like second end portion is releasably disposed at least in part in the non-threaded lumen.

11. A system for recycling blow-by gases from an engine crankcase including:

an oil and air separation can coupled to an adapter including means for releasably engaging an engine oil fill port.

12. The system of claim 11, wherein the oil and air separation can is coupled to the adapter via a hose.

13. The system of claim 11, wherein the adapter includes a second end portion and an assembly at least partially disposed within a non-threaded lumen formed in the second end portion.

14. The system of claim 13, wherein the assembly portion disposed within the non-threaded lumen is releasably held in place by a button.

15. The system of claim 14, wherein the assembly portion disposed within the non-threaded lumen includes a shoulder releasably engageable by the button.

16. The system of claim 13, wherein the assembly portion disposed within the non-threaded lumen is releasably held in place by a clip.

* * * * *